United States Patent [19]

Jernstrom

[11] 4,044,496

[45] Aug. 30, 1977

[54] BUBBLE BLOWER

[76] Inventor: Hans Jernstrom, 1 Villa Verdi, Apt. 111, Buffalo Grove, Ill. 60090

[21] Appl. No.: 640,826

[22] Filed: Dec. 15, 1975

[51] Int. Cl.[2] ..... A63H 33/28

[52] U.S. Cl. ..... 46/7

[58] Field of Search ..... 46/6, 7, 8

[56] References Cited

U.S. PATENT DOCUMENTS

| | | | |
|---|---|---|---|
| 2,547,825 | 4/1951 | King | 46/8 |
| 2,974,438 | 3/1961 | Hopkins | 46/8 |
| 3,100,947 | 8/1963 | Hellman | 46/8 |

FOREIGN PATENT DOCUMENTS

| | | | |
|---|---|---|---|
| 487,368 | 10/1952 | Canada | 46/8 |

*Primary Examiner*—Louis G. Mancene
*Assistant Examiner*—Robert F. Cutting
*Attorney, Agent, or Firm*—Gerald S. Geren

[57] ABSTRACT

There is disclosed herein a toy bubble-blowing machine which includes a housing and an associated bubble-forming mechanism. The bubble-forming mechanism includes a plurality of elements, with only one—a hand crank—being positioned outside of the housing. The hand crank is rotatable and is connected to a main drive shaft and drive gear. A propeller which is positioned within the housing and above the drive shaft is drivingly interconnected with the drive gear by a gear train for rotation at a speed greater than the speed of the shaft. A bubble dipper is secured to the drive shaft for rotation through a reservoir of bubble-forming liquid within the housing and for forming a film of the bubble-forming liquid. As the dipper is rotated, the dipper positions the film in the airstream from the propeller so as to form bubbles from the film.

11 Claims, 5 Drawing Figures

FIG. 1
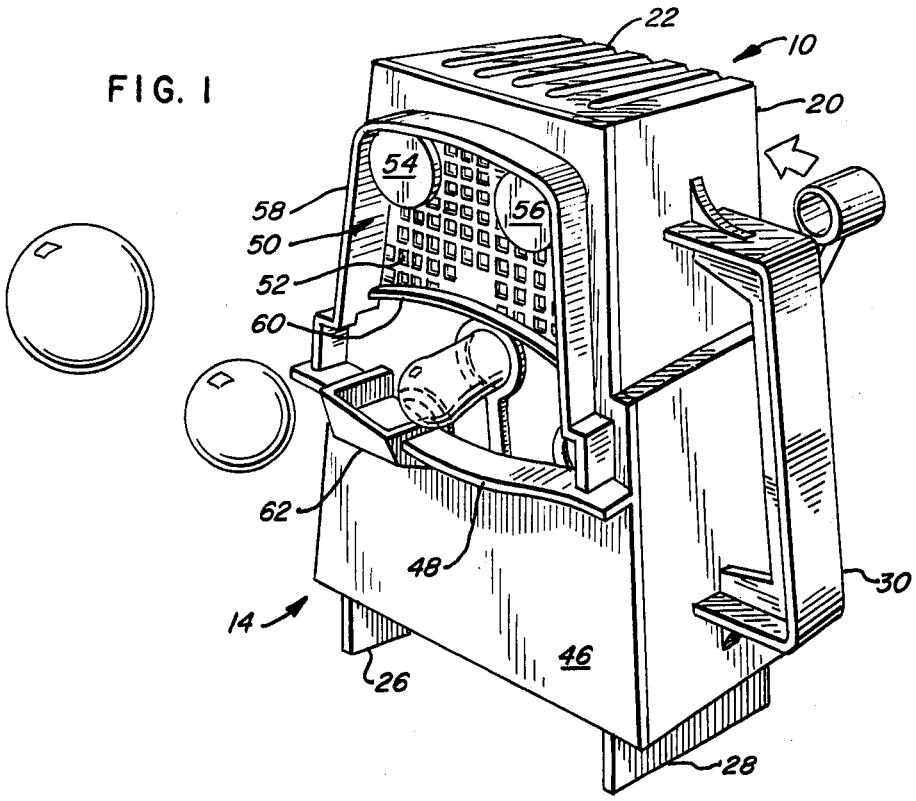
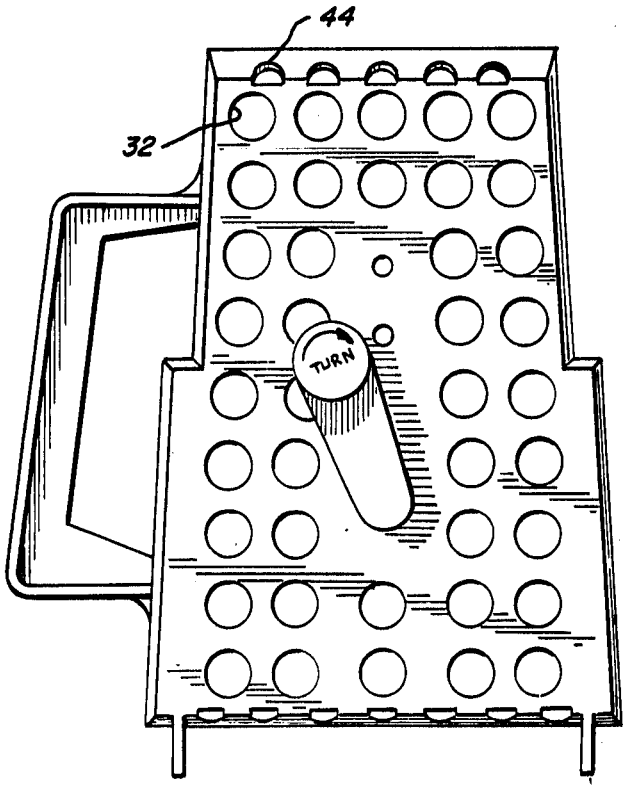
FIG. 2

BUBBLE BLOWER

BACKGROUND OF THE INVENTION

This invention relates to a toy and more particularly to a toy bubble-blowing machine.

Toy bubble-blowing machines are devices by which a child can produce a relatively continuous stream of bubbles from a bubble-forming liquid or solution stored within the machine. These machines usually include: a reservoir for holding the bubble-forming liquid; a rotatable dipper having apertures or rings for picking up the liquid and forming a film from which the bubble is formed; means for blowing air through the dipper rings or apertures so as to form the bubble; and drive means for rotating the dipper and in some situations for providing the air flow necessary for forming the bubbles.

The bubble-blowing machines can be classified according to their drive means. Thus there are (1) breath-actuated devices, such as shown in U.S. Pat. Nos. 2,628,449, 2,736,988 and 2,987,847; (2) electrically-driven devices as shown in U.S. Pat. Nos. 2,412,732 and 3,100,947; or (3) mechanically-driven devices as shown in U.S. Pat. Nos. 2,547,825 and 2,794,292.

Breath-actuated devices are felt to be undesirable since parents generally prefer to avoid purchasing or permitting their children to use a toy which the child must place in its mouth. The electrically actuated toys are felt to be undesirable since parents may avoid purchasing or permitting their children to use toys which have a fan or impeller that is driven at high speeds by an electrical motor. Such electrical toys present both electrical and mechanical hazards. The prior art mechanically driven bubble-blowers are generally suitable from a safety point of view but have not been widely accepted.

It is therefore an object of this invention to provide a mechanically driven bubble-blowing machine which is safe for a child to use, acceptable to parents, and which is relatively simple in design and inexpensive to manufacture.

These and other objects of this invention will become apparent from the following disclosure and appended claims.

SUMMARY OF THE INVENTION

There is provided by virtue of this invention an improved mechanically actuated bubble-blowing machine which is safe to use, parentally acceptable, of a relatively simple design and inexpensive to manufacture.

The machine herein includes a housing which is shaped to enhance air flow therethrough and to provide a bubble-forming liquid reservoir. A bubble-forming mechanism is also provided which includes an externally-positioned hand crank for driving internal bubble-forming elements. The internal bubble-forming elements include a main drive shaft which is journalled to the housing and is connected at one end to the hand crank. A dipper is mounted on the drive shaft at the other end for rotation with the shaft and through the reservoir. A propeller is positioned above the shaft and rearwardly of the dipper for directing air through the dipper as it exits the reservoir. The propeller is connected to the shaft by a gear train and is driven at a speed substantially greater than that of the dipper.

The machine is fabricated from relatively inexpensive parts which are capable of mass production by techniques such as injection molding.

BRIEF DESCRIPTION OF THE DRAWINGS

FIG. 1 is a perspective view of a bubble-blowing machine in accordance with principles of the present invention;

FIG. 2 is a rear view of the bubble-blowing machine;

DESCRIPTION OF THE PREFERRED EMBODIMENT

The Housing

Figure 3:
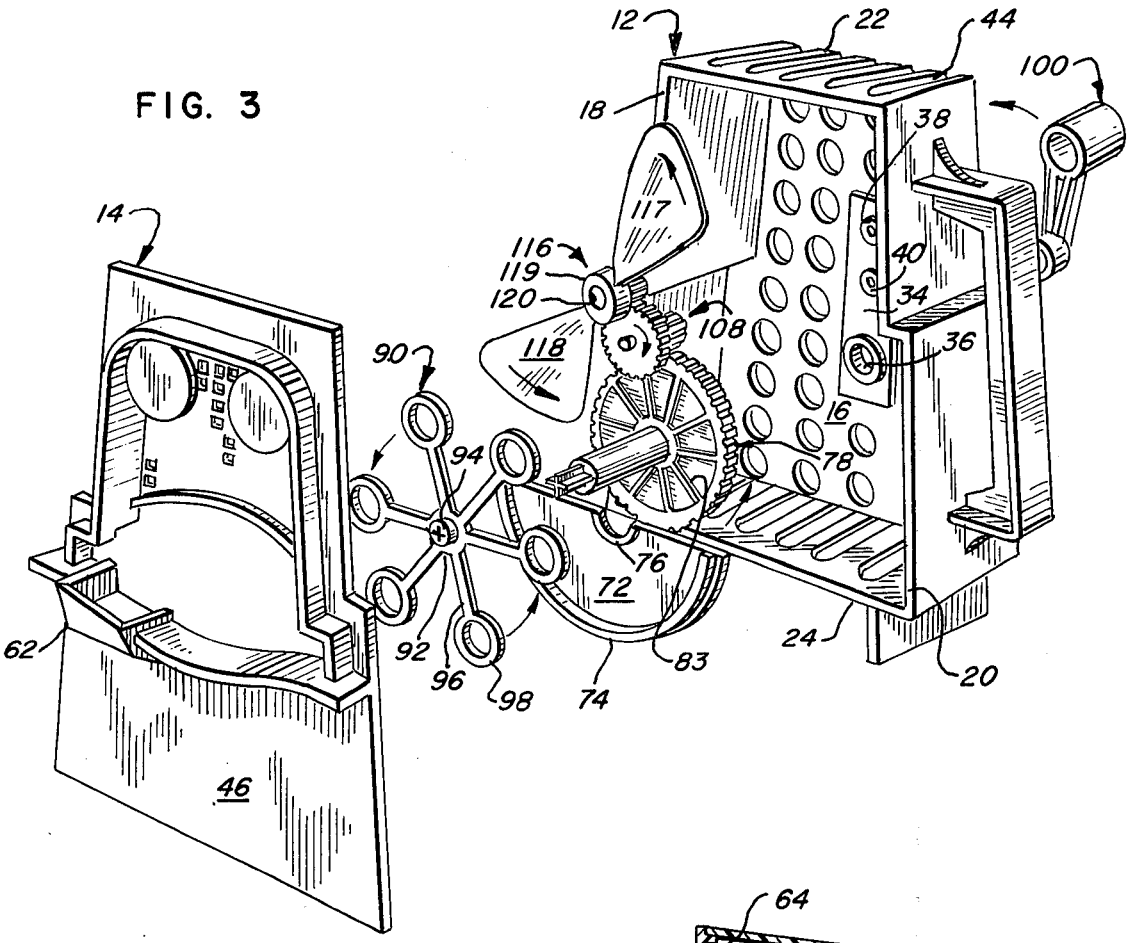
FIG. 3 is an exploded perspective view of the bubble-blowing machine.
Figure 4:
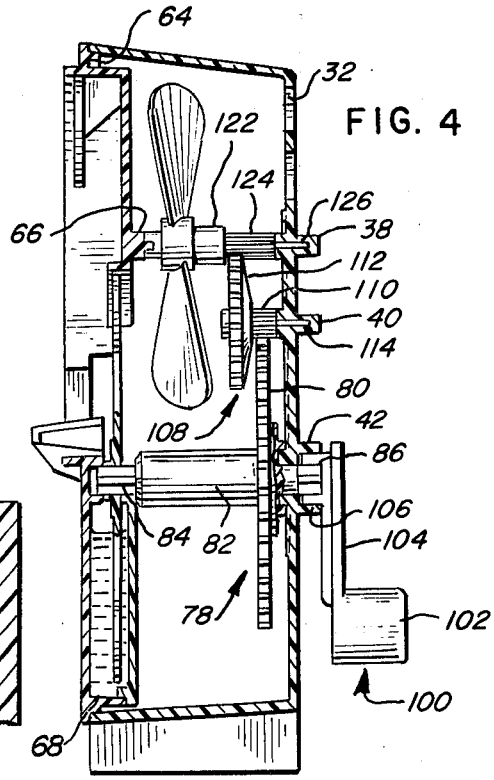
FIG. 4 is a side view of the bubble-blowing machine with the housing portion shown in section.
Figure 5:
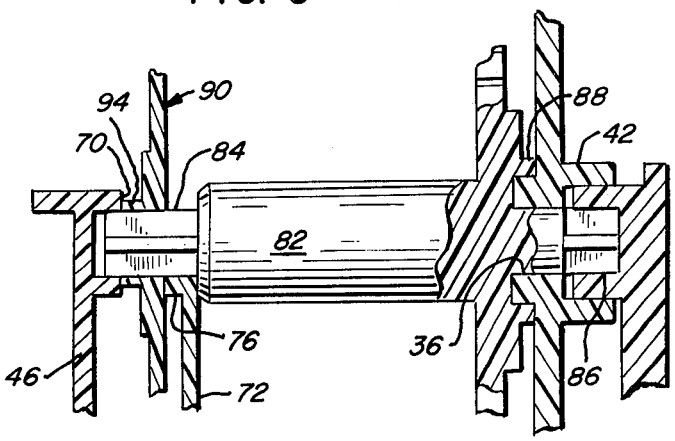
FIG. 5 is an enlarged view showing the drive shaft, dipper and hand crank connections.

Referring now to the drawings, the bubble-blowing machine 10 includes a two-part housing which has a recessed rear section 12 and a front wall section 14. Both sections of the housing are made of an injection-molded, impact-resistant plastic, such as styrene.

The rear section 12 includes a rear wall 16, a pair of stepped sidewalls 18 and 20, and top and bottom walls 22 and 24. A pair of legs 26 and 28 extend downwardly from a bottom wall 24 and a C-shaped grasping handle 30 is provided on the outside of the sidewall 20.

The rear wall 16 includes a plurality of circular air inlets, such as 32. A centrally positioned mounting plate 34 is provided on the inner surface of the rear wall 16 and includes a boss-like journal 36 and two mounting pin-receiving bosses 38 and 40. A crank-receiving socket 42 is provided on the outer side of the rear wall and in alignment with the journal 36.

Both the top wall 22 and the bottom wall 24 include a plurality of elongated air inlets such as 44, which extend from a point adjacent the forward edge of the top or bottom wall to the rear wall. The sidewalls 18 and 20 are each stepped and extend forwardly from the rear wall. It will be noted that the sidewalls and top and bottom walls all extend forwardly and slightly outwardly from the rear wall (i.e.—flare outwardly) so as to provide a diverging nozzle-like shape to the rear section 12 of the housing. This shaping enhances air flow through the housing.

The front wall portion 14 of the housing is molded so as to provide a face-like appearance. The wall includes a solid lower section 46, a lip-like forwardly-projecting ledge 48; a screen-like upper section 50, which has a plurality of square air-flow apertures 52 and a pair of decorative eye-forming discs 54 and 56. A hood-like shoulder or ledge 58 extends forwardly of the front wall and surrounds the screen-like section 52 and eye-forming discs 54 and 56. A smaller lip-like ledge 60 defines the lower edge of the screen-like section 50 and also in cooperation with the ledge 48 and portions of the hood section 58 define a mouth-like opening or outlet through which bubbles exit the bubble blowing machine. A trough 62 is molded into the ledge 48 for use in pouring a bubble-forming liquid into the machine.

A peripheral internal shoulder 64 on the back side of the front wall is provided for cooperation in securing the front wall to the rear section 12. The shoulder engages the inner surface of the outer edge of the sidewalls, top wall and bottom wall and is bonded thereto. A propeller bearing post 66 extends rearwardly from the back side of the front wall behind the screen section 50 and in general in axial alignment with the pin receiving boss 38.

A semicircular wall 68 is integral with and projects rearwardly from the front wall behind the solid section 46. The wall 68 provides a semicircular shape and cooperates in defining the bubble-forming liquid reservoir. A circular socket 70 is provided on the rear side of the front wall and is positioned in generally axial alignment with the journal 36.

A reservoir defining cover plate 72, which includes an outer peripheral semicircular shoulder 74 and an inner peripheral semicircular shoulder 76 is provided for cooperation with the wall 68 to define the reservoir. The outer peripheral shoulder engages the wall 68 and is bonded thereto. The inner shoulder is spaced from the socket but is aligned therewith. The trough 62 is aligned with the reservoir so that the bubble-forming liquid poured into the trough is directed into the reservoir.

Bubble-Forming Mechanism

The bubble-forming mechanism includes a molded plastic gear and shaft member 78 which has a large spur gear 80 and a shaft 82. The spur gear 80 has 96 teeth and a plurality of apertures such as 83 between the spokes of the gear. The shaft 82 includes a reduced diameter section having an X-shaped spline 84 at its forward end and a reduced diameter X-shaped spline 86 at its rearward end. Each of the splines includes round tipped ends and is constructed for cooperation with (a) the forward journal socket 70 and shoulder 76; and (b) the rearward journal 36. A guide shoulder and spacing ring 88 is provided on the shaft rearwardly of the gear and is arranged to surround the inward boss-like projection of the journal 36 and also to abut the mounting plate 34. This provides restraint for axial movement of the shaft.

A rotatable bubble arm or dipper 90 is provided which includes a central hub 92 having an X-shaped spline-receiving opening 94 therein and six radially-extending bubble arms, each of which includes an arm such as 96 having a bubble film-forming ring such as 98 at the outer end thereof. The dipper is adapted to slidably fit on the spline 84 and also to be positioned in the reservoir between the front wall section 46 and the cover plate 72 with the hub between the socket 70 and the shoulder 76. The X-shaped spline is received and rotatably mounted in the socket 70.

A hand crank 100 is provided for driving the shaft and includes a graspable knob section 102, an arm section 104 and a hub section 106 which is molded for pressfitting engagement with the X-shaped spline 86. The hub is shaped to fit within the crank arm socket 42.

A combination spur-and-pinion gear 108 which has a pinion gear 110 for gearing cooperation with the spur gear 80 and a spur gear 112, is carried on the back wall of the housing. A gear support pin and bearing 114 is fixed in the boss 40 and extends through a bore in the hub of gear 108. Thus the gear 108 is mounted for rotation about the pin 114. The pinion gear has six teeth and the spur gear has 40 teeth.

A fan or propeller 116 is provided which includes two blades 117 and 118 and a hub 119 having a central socket 120 at its forward end which is adapted to engage the support boss 66 on the front wall. A shaft section 122 extends rearwardly from the hub and terminates in a pinion gear section 124. The shaft section includes a pin-receiving bore for cooperation with a mounting pin 126 that fits within the boss 38. The pinion gear 124 is arranged to engage the spur gear 112.

Assembly

Due to its construction the bubble-blowing machine may be assembled in the following manner. The rearward section 12 is placed on its back and the mounting pins 114 and 126 are placed in the pin bosses 38 and 40. The gear and shaft member 78 is positioned so that the spline 86 extends through the journal section 36. Next the combination pinion and spur gear 108 is fitted onto the pin 114 in boss 40 so that the pinion gear 110 and the spur gear 80 mate. Next, the fan 116 is positioned by slipping the pinion gear into engagement with the spur gear 112 and with the pin 126. Next the front wall is assembled by placing the dipper in position and then mounting the reservoir defining cover plate to the front wall. The dipper is mounted to the front end of the drive shaft and the front wall is mounted to the rear section with the bearing 66 fitted within the front end of the propeller 120. With all of the members in place, the front wall is bonded to the rear section 112 along the peripheral shoulder 64. Then, the crank 100 is fitted to the rear section of the spline 86.

Operation

To operate the bubble blower the handle 30 is grasped in the left hand and the crank knob 102 is grasped in the right hand and rotated in the clockwise direction as viewed from the back. This drives the dipper at the same rate of rotation as the crank arm. However, due to the step-up gearing relationship between the spur gear 80, the pinion gear 110, the spur gear 112, and the pinion gear 124, the propeller blades are driven at a speed substantially greater than the speed of the crank and dipper. For each complete revolution of the handcrank, the propeller revolves about 105 times. This relationship is also true for the dipper and propeller.

The action of the propeller draws air through the air inlets and the top, bottom and rear walls and directs the air out through the front screen 50 and through the outlet in the front wall. It will be noted that the axis of rotation of the propeller is positioned vertically above the axis of rotation of the drive shaft and the propeller is positioned rearwardly of the dipper. Furthermore, the blades of the propeller are arranged so that when they are in a position beneath the propeller's axis of rotation, they are generally aligned in air flow relationship with the outlet in the fornt wall and with the rings of the dipper after they leave the reservoir.

The dipper rotates through the reservoir and thus picks up the bubble-forming liquid, forms a film in the ring and rotates to a position aligned with the outlet in the front wall. Air drawn into the housing by the propeller flows through the outlet and the dipper rings move into the air stream. The air flowing through the rings causes the film to form into a bubble which exits the bubble blowing machine through the outlet.

It will be appreciated that numerous changes and modifications can be made to the embodiment disclosed herein without departing from the spirit and scope of this invention.

What is claimed and desired to be secured by Letters Patent of the United States is:

1. A hand-operated bubble-blowing machine which includes:

a. a housing having:

i. a rear wall, a larger front wall spaced therefrom, outwardly flaring side, top and bottom walls which interconnect the rear and front walls and form a forwardly tapering nozzle-like structure which enhances air flow through said housing;

ii. air inlet means in said rear wall;

iii. air inlet means in each of said top and bottom walls;

iv. bubble outlet means generally centrally positioned in said front wall;

v. means defining a reservoir for bubble-forming liquid positioned within said housing below said bubble outlet means and cooperatively associated with said front wall;

b. a bubble-forming mechanism cooperatively associated with said housing which includes:

i. main shaft means rotatably mounted within said housing and journalled to said front wall and said rear wall at positions below the bubble outlet means;

ii. externally positioned hand crank means associated with said rear wall and secured to one end of said shaft means for rotating said shaft means;

iii. propeller means positioned within said housing and rotatably mounted to said front and rear walls above said bubble outlet means and main shaft means, for drawing air through said inlet means and creating a bubble-forming air stream directed toward said bubble outlet means, with the axis of rotation of said propeller means substantially parallel to and vertically offset from said main shaft means;

iv. gear means for drivingly interconnecting said main shaft means and said propeller means and for rotating said propeller means at a rate substantially greater than the rotation of said main shaft; and v. dipper means, mounted on said shaft means for rotation therewith, which includes a hub, a plurality of arms extending radially from said hub and a plurality of bubble-forming rings, one mounted to the distal end of each of said arms, said dipper means being positioned within said housing and for rotation through said reservoir means for forming a film of bubble-forming liquid in said rings, and for positioning said film in said air stream and in alignment with said bubble outlet means.

2. A toy bubble-blowing machine for use by a child comprising:

a housing;

a reservoir for a bubble-forming liquid associated with said housing;

rotatable dipper means associated with said housing and rotatable through said reservoir for forming a bubble-forming film;

drive means for rotating said dipper means; and means for creating a bubble-forming air stream directd toward said dipper means;

wherein the improvement comprising:

said housing having a front wall including means defining generally centrally positioned bubble outlet through which bubbles issue from said machine;

said reservoir being positioned within sais housing at a position below said bubble outlet means;

said dipper means being rotatably mounted within said housing on first shaft means with the axis of rotation of said first means being below said bubble outlet means and arranged to position a bubble-forming film in alignment with said bubble outlet means; and said means for creating an air stream comprising rotatable propeller means rotatably mounted within said housing on second shaft means with the axis of rotation of said second means being above said bubble outlet means, and said propeller means being adapted to direct an air stream toward said bubble outlet means.

3. A bubble-forming machine as in claim 2, wherein said dipper shaft axis of rotation and propeller shaft axis of rotation are substantially vertically aligned and generally parallel.

4. A bubble-forming machine as in claim 2, wherein said drive means includes: said dipper shaft means journalled to said housing at a position below said bubble outlet means and having said dipper means mounted thereon at one end; and hand crank means positioned outside of said housing and operatively associated with the other end of said dipper shaft means for rotating said dipper shaft means and dipper means.

5. A bubble-blowing machine as in claim 4, wherein said propeller shaft means, having said propeller means mounted thereon is drivingly associated with said dipper shaft means, so as to be driven by rotation of said hand crank.

6. A bubble-forming machine as in claim 5, further comprising drive gear means for drivingly interconnecting said dipper shaft means and said propeller shaft means for rotating said propeller means at a rate greater than said dipper means.

7. A bubble-forming machine as in claim 2, wherein said reservoir includes a reservoir defining wall having peripheral shoulder means for cooperation with said front wall to form said reservoir.

8. A bubble-forming machine as in claim 2, wherein said housing is generally rectangular in shape, and includes a rear section for cooperation with said front wall in forming said housing, said rear section comprising:

a rear wall having a plurality of air inlets therein, said rear wall being smaller than said front wall and spaced therefrom; and outwardly flaring side, top and bottom walls which cooperate with said rear wall and said front wall so as to define a forwardly tapering nozzle-like structure to enhance air flow through said housing.

9. A bubble-blowing machine as in claim 8, wherein said top wall and bottom wall include air inlet apertures.

10. A bubble-blowing machine as in claim 8, wherein said rear section is a unitary molded member.

11. A bubbler-blowing machine as in claim 2, wherein there is further provided handle means mounted to said housing so that in the operation of the machine an operator grasps the handle means with one hand and said crank with the other hand.

* * * * *

UNITED STATES PATENT OFFICE

CERTIFICATE OF CORRECTION

Patent No. 4,044,496 Dated Aug. 30, 1977

Inventor(s) HANS JERNSTROM

It is certified that error appears in the above-identified patent and that said Letters Patent are hereby corrected as shown below:

Column 4, line 47, change "fornt" to -- front --

Column 6, line 1, change "sais" to -- said --

Column 6, line 12, after word "second" -- shaft -- was omitted

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*